US006531829B1

(12) United States Patent
Tsai

(10) Patent No.: US 6,531,829 B1
(45) Date of Patent: Mar. 11, 2003

(54) CONNECTOR OF A DECORATIVE LIGHTING STRING

(76) Inventor: Chin-Sung Tsai, No. 65, Shien Cheng 11th Street, Chupei City, Hsinchu Hsien (TW)

( * ) Notice: Subject to any disclaimer, the term of this patent is extended or adjusted under 35 U.S.C. 154(b) by 0 days.

(21) Appl. No.: 10/059,298

(22) Filed: Jan. 31, 2002

(51) Int. Cl.[7] ..... H05B 37/00

(52) U.S. Cl. ..... 315/185 S; 362/396; 362/252; 362/806

(58) Field of Search ..... 315/185 S; 362/391, 362/396, 806, 252, 257

(56) References Cited

U.S. PATENT DOCUMENTS 4,769,749 A * 9/1988 Felski ..... 362/252
5,245,519 A * 9/1993 Openiano ..... 362/806
5,584,567 A * 12/1996 Rumpel ..... 362/252
5,868,490 A * 2/1999 Barthelmess ..... 362/252
6,004,006 A * 12/1999 Wang ..... 362/396
6,019,634 A * 2/2000 Tseng ..... 362/396
6,068,229 A * 5/2000 Wang et al. ..... 362/396
6,109,569 A * 8/2000 Sakaida ..... 362/396
6,344,716 B1 * 2/2002 Gibboney, Jr. ..... 248/75
6,352,353 B1 * 3/2002 Liu ..... 315/185 S

* cited by examiner

*Primary Examiner*—Don Wong
*Assistant Examiner*—Ephrem Alemu
(74) *Attorney, Agent, or Firm*—Rosenberg, Klein & Lee

(57) ABSTRACT

The present invention relates to a connector of a decorative lighting string, which mainly designs a plastic connector for easily positioning around the electrical wire of the string. The connector can firmly engage with several bulb-assemblies having positioning rod very conveniently that gathers lighting bulbs at a similar position in order to increase decorative effect.

2 Claims, 4 Drawing Sheets

CONNECTOR OF A DECORATIVE LIGHTING STRING

BACKGROUND OF THE INVENTION

A regular decorative lighting string includes an electrical wire, which is provided with several bulb-assemblies in interval to provide a simple decoration. A conventional lighting string has though been provided with two or more bulb-assemblies on the electrical wire at a nearby position for increasing lighting effect. But the bulb-assemblies are placed in great disorder that can not increase decorative or beautiful purpose.

Accordingly, the primary object of the invention is to provide a connector of a decorative lighting string, which provides a connector with several connecting grooves for engaging with several bulb-assemblies around the electrical wire at a same position for better decoration. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
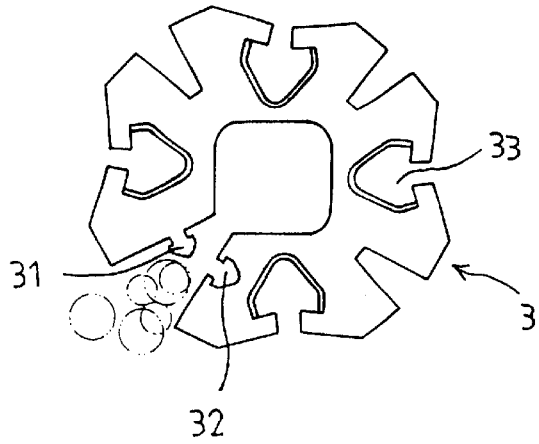
FIG. 1 is a top plan view showing a connector of a decorative lighting string according to the present invention.
Figure 2:
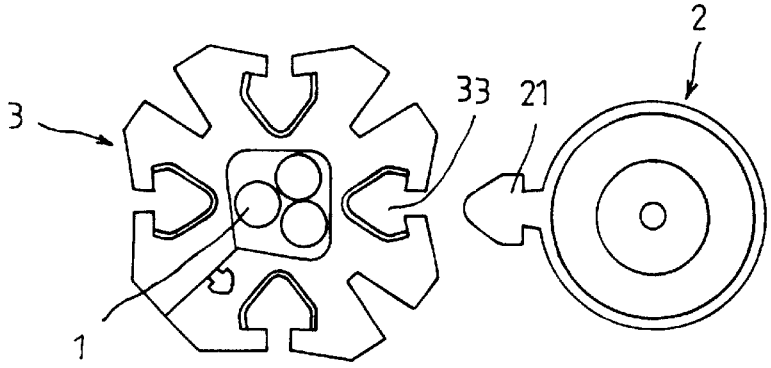
FIG. 2 is a top plan view showing the connector of FIG. 1 with electrical wires and a bulb-assembly according to the present invention.
Figure 3:
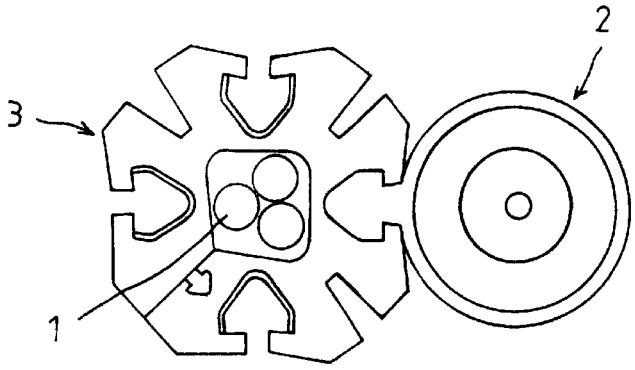
FIG. 3 is a plan view showing the assembly of FIG. 3 according to the present invention.

Please firstly refer to FIGS. 1 to 3, the present invention mainly provides a connector (3), which is made of plastic material. The connector (3) is formed a hook (31) at one end to engage with a connecting groove (32) at other end to become a firm body that receives electrical wires (1). On the other hand, the connector (3) is fixed on the electrical wire (1). Each side of the connector (3) is formed an engaged groove (33). A bulb-assembly (2) has a side positioning rod (21), which can be inserted into the engaged groove (33) to obtain a secure engagement.

Figure 4:
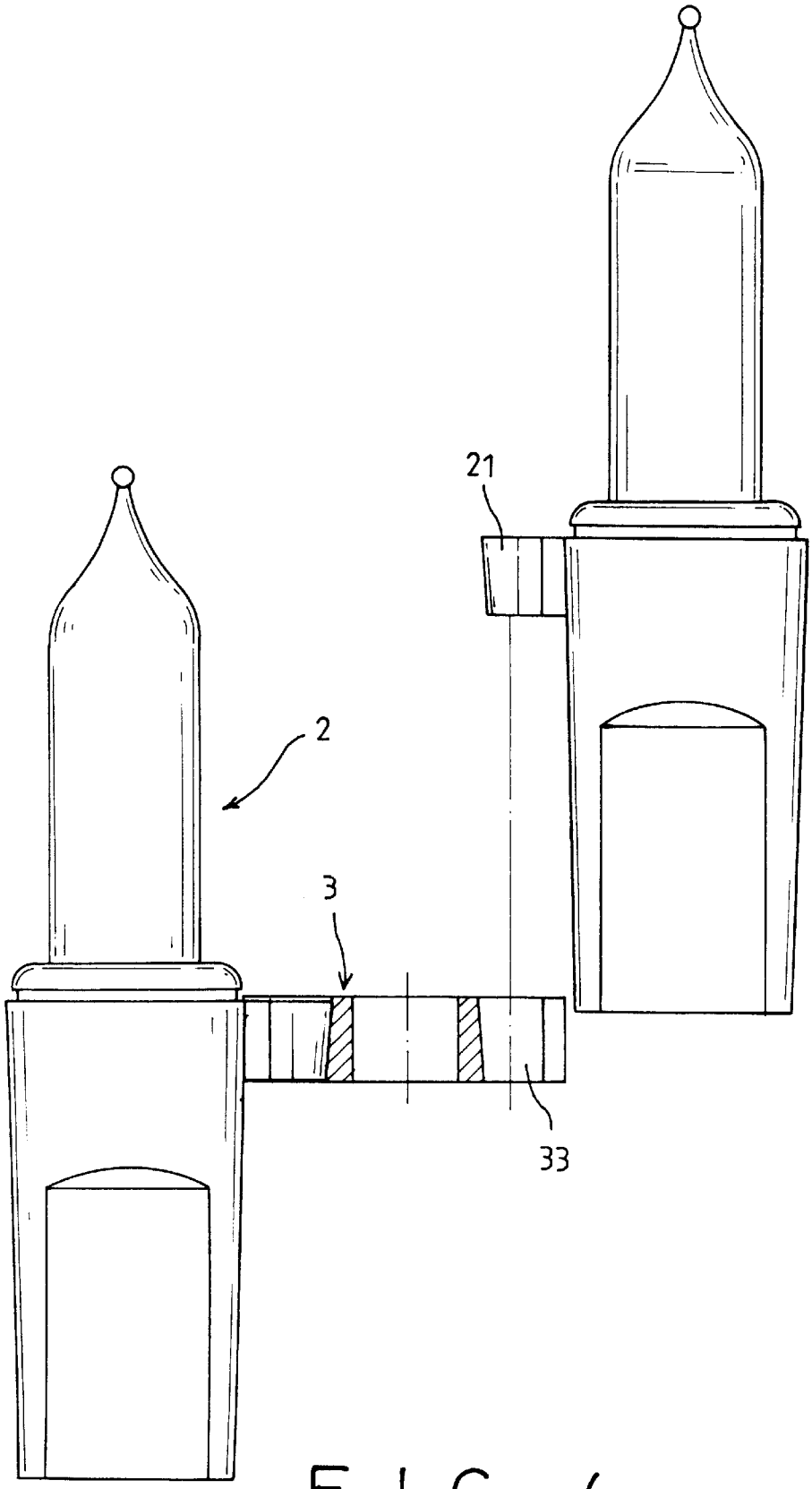
FIG. 4 is a front plan view showing the connector with the bulb-assemblies according to the present invention.
Figure 5:
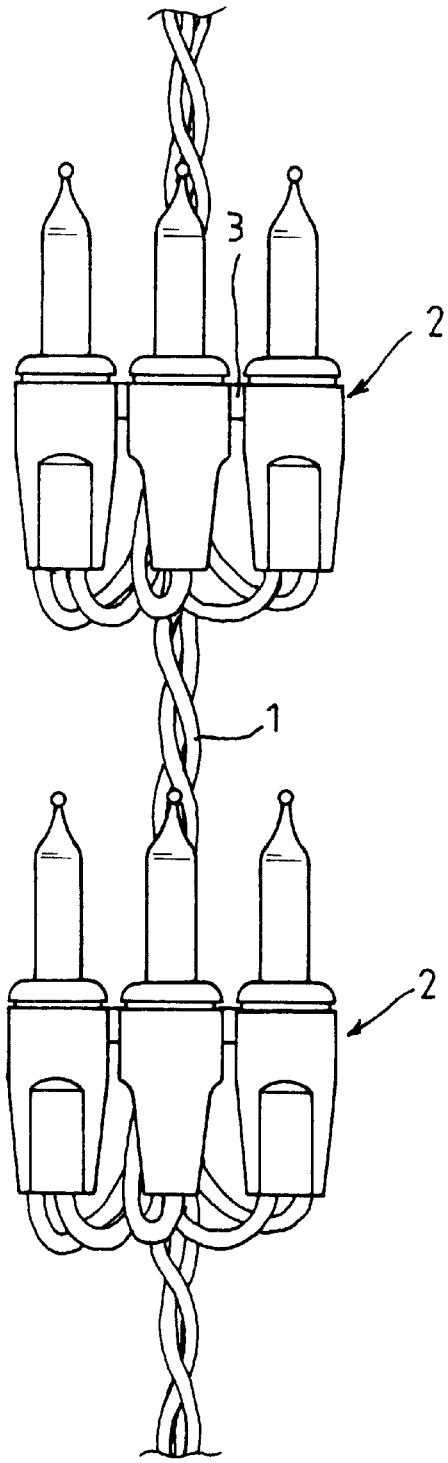
FIG. 5 is a front plan view showing the application according to the present invention.
Figure 6:
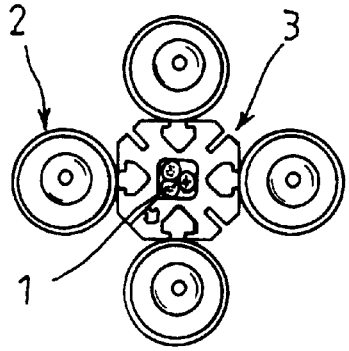
FIG. 6 is a top plan view of FIG. 5 according to the present invention.

In application, the present invention provides several connectors (3) in interval on the electrical (1), while several bulb-assemblies are connected with the electrical wire (1) at similar position. So each bulb-assembly (2) can be engaged with the connector (3) firmly, as shown in FIG. 4 to 6. It can be found that the decorative lighting string according the present invention provides a special decorative effect that gathers several lighting bulbs together to show a better effect.

Figure 7:
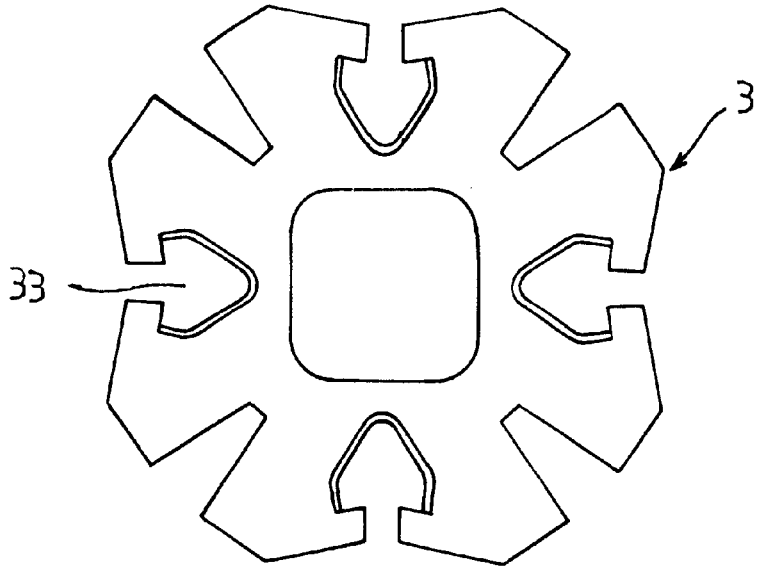
FIG. 7 is a top plan view showing another modified connector according to the present invention.
Figure 8:
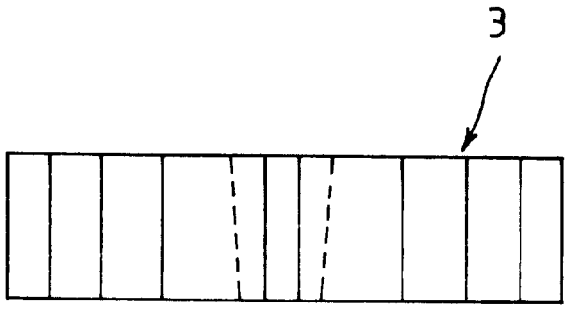
FIG. 8 is a front plan view of FIG. 7 according to the present invention.

Accordingly, the invention uses a connector provided on the electrical wire to increase a novel and unique decorative effect and it is better that any prior art. Moreover, the said description is only an exemplary and is not to limit any other modification under the same spirit of the present invention. Such as shown in FIGS. 7 and 8, it shows a connector (3) being formed as a single molded body for being positioned on the electrical wire (1) in advance during manufacturing of the lighting string. It can engage with the bulb-assemblies (2) in secure to reach a same effect.

Accordingly, the assembly of the present invention obviously obtains utility and improvement. It should be allowed for patent and is applied.

What is claimed is:

1. A connector of a decorative lighting string including a plurality of electrical wires with several bulb-assemblies at intervals of a distance, and the characteristic is each bulb-assembly is provided with a side positioning rod, and a connector being made of plastic material and having a hook at one end to engage with a connecting groove to become a complete body and to receive the electrical wires inside; several engaged grooves are formed around the connector for engaging with several bulb-assemblies on the connector that gathers a plurality of lighting bulbs at a position on the electrical wires in order.

2. The connector of a decorative lighting string as claimed in claim 1, wherein the connector is formed as a single molded body for positioning around the electrical wires in advance during manufacturing of the lighting string.

* * * * *